United States Patent [19]

Schneider et al.

[11] Patent Number: 4,865,229

[45] Date of Patent: Sep. 12, 1989

[54] DOSING GUN FOR LIQUIDS AND PASTES

[75] Inventors: Friedhelm Schneider, Fichtenstrasse 7, D-5226 Reichshof-Wiehl; Alfred Weiss, Olpe, both of Fed. Rep. of Germany

[73] Assignee: Friedhelm Schneider, Reichshof-Wiehl, Fed. Rep. of Germany

[21] Appl. No.: 152,534

[22] Filed: Feb. 5, 1988

[30] Foreign Application Priority Data

Feb. 11, 1987 [DE] Fed. Rep. of Germany ..... 3704210

[51] Int. Cl.[4] ..... B65D 88/54; B67D 5/42

[52] U.S. Cl. ..... 222/325; 222/108; 222/340; 222/391; 222/392

[58] Field of Search ..... 222/95, 105, 108, 325–327, 222/336, 340, 391, 392, 571

[56] References Cited

U.S. PATENT DOCUMENTS

| | | | |
|---|---|---|---|
| 2,093,387 | 9/1937 | Tear | 222/392 |
| 3,389,838 | 6/1968 | Morra et al. | 222/326 X |
| 3,782,598 | 1/1974 | Basa | 222/340 X |

*Primary Examiner*—Kevin P. Shaver
*Assistant Examiner*—Gregory L. Huson
*Attorney, Agent, or Firm*—Flynn, Thiel, Boutell & Tanis

[57] ABSTRACT

A dosing gun consists substantially of a housing having a trigger device with a trigger lever, with which a piston arranged on a piston rod can be operated evenly by a spring, which spring is initially compressed by a use of the trigger lever and a band brake. For this purpose a cord, which can be wound up onto a cord drum, is secured to an end of the piston rod. A brake drum which is secured on a drive shaft and can be operated by a brake band, is arranged in one piece on the cord drum. With the hand wheel mounted on a left side of the drive shaft, it is possible to wind the cord onto the cord drum and to compress the spring.

9 Claims, 1 Drawing Sheet

DOSING GUN FOR LIQUIDS AND PASTES

FIELD OF THE INVENTION

The invention relates to a dosing gun for liquids and pastes.

BACKGROUND OF THE INVENTION

Dosing guns used for example for filling of joints or packing gaps with liquid adhesives or silicone pastes.

Dosing guns for liquids and pastes of the above-mentioned type are already known. Such a gun consists of a housing on which is provided a trigger device with a trigger lever, which through repeated operations of the trigger lever and an associated driving mechanism, moves a piston rod with a piston in an axial direction. It is in this manner, for example, possible to empty a liquid or paste filled cartridge which has been inserted into the dosing gun through a discharge nozzle.

A disadvantage in dosing guns of this design is that through the jerky operation of the piston rod, liquid or paste is moved very unevenly out of the cartridge and thus a satisfactory operation is hindered.

Therefore, the basic purpose of the invention is to provide a dosing gun of the above-mentioned type, with which the piston rod of the dosing gun is movable evenly in axial conveying direction, so that liquid or paste can be conveyed evenly and continuously out of the cartridge and thus a satisfactory operation is made possible.

The advantages achieved with the invention consist in particular in the piston of the piston rod being evenly movable in axial conveying direction and liquid or paste thus being able to be moved evenly and continuously out of the cartridge. This is achieved, by the inventive dosing gun, substantially through a spring, preferably a gas-pressure spring arranged around the piston rod, receiving an initial tension with the help of a trigger lever of a trigger device. The initial tension can be controlled by a band brake such that a cord secured to the piston rod can be wound onto a cord drum equipped with a brake drum onto which acts a brake band connected to a rocker arm when the trigger lever operates or releases a spring mechanism of the rocker arm and a pressure rod secured thereon with a roller acts onto the cord.

BRIEF DESCRIPTION OF THE DRAWINGS

Exemplary embodiments of the invention are illustrated in the drawing and will be discussed in greater detail hereinafter.

In the drawing.

DETAILED DESCRIPTION

Figures 1, 2:
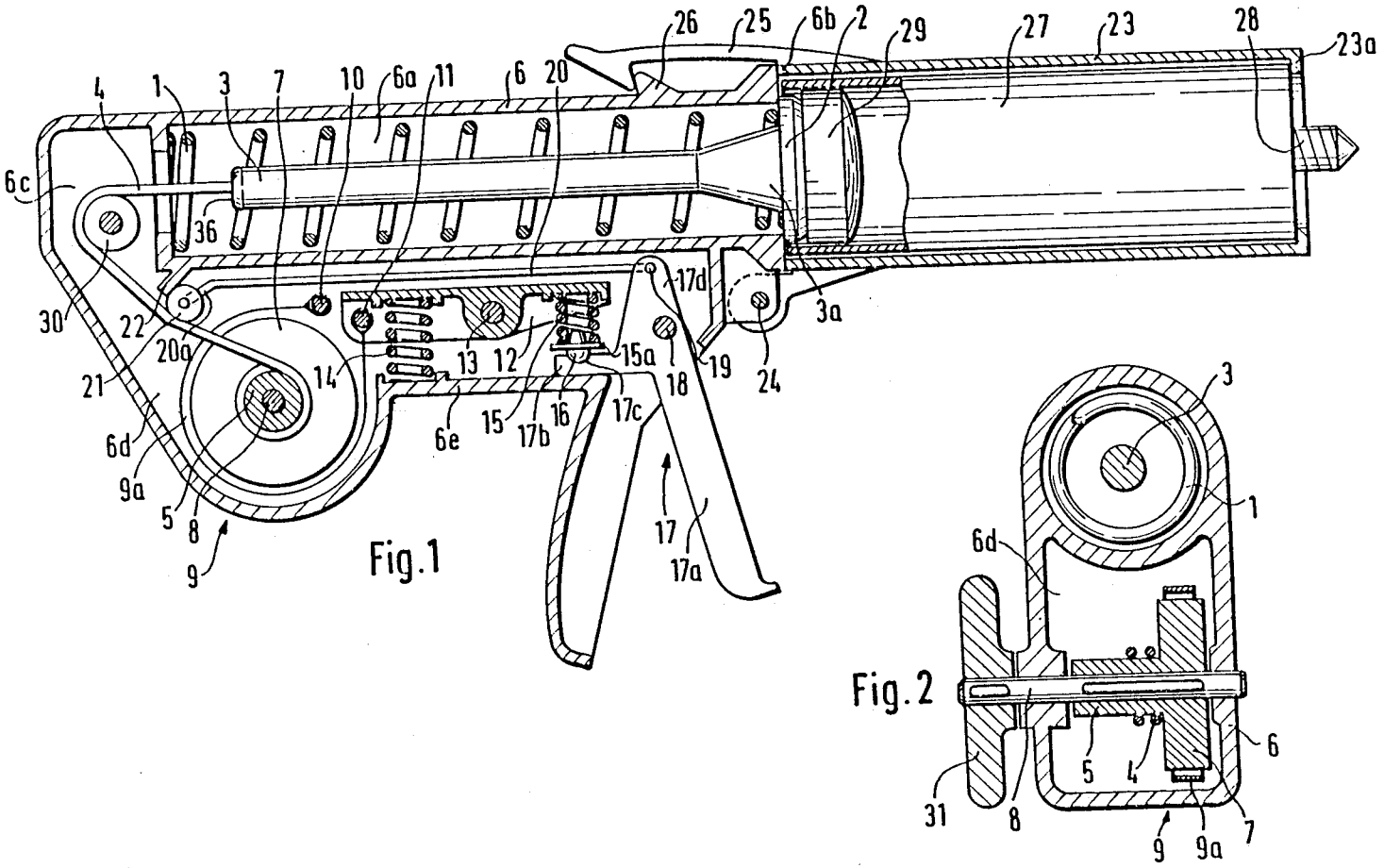
FIG. 1 is a longitudinal cross-sectional view of the inventive dosing gun in an at rest position with a fully retracted spring.
FIG. 2 is a cross-sectional view of the left end of the inventive dosing gun.

FIG. 1 illustrates in a longitudinal cross-sectional view of the inventive dosing gun arranged in a housing 6 and in a rest position with the spring 1 fully retracted. The compressible spring 1, provided in an upper part 6a of the housing 6, surrounds a piston rod 3 which has a piston-rod shoulder 3a and on which a piston 2 is arranged, which in the rest position of the inventive dosing gun loads a truncated-cone-shaped front side 6b of the housing 6.

A cord 4 is secured to one end 3b of the piston rod 3, which cord is guided over a guide roller 30 provided in a rear housing part 6c and wound onto a cord drum 5 provided in a lower housing part 6d. A brake drum 7, which is constructed in one piece with the cord drum, has a band brake 9a, secured to pivot points 10 and 11 in the lower housing part 6d. The brake drum 7 forming one unit with the cord drum 5 is secured on a drive shaft 8. A brake band 9a forms together with the brake drum 7 the band brake 9a, which holds the cord 4, so that it cannot be pulled back by the force of the spring 1. While the pivot point 10 for the brake 9a is connected fixedly to the lower housing part 6d, its pivot point 11 is supported in a rocker arm 12, which is also provided in the lower housing part 6d.

The rocker arm 12 in turn is rotatably supported about a bolt 13. A spring 14, which is provided between a left underside portion of the rocker arm 12 and a wall portion 6e of the lower housing part 6d, is installed under a large initial compression and tightens the brake band 9a through an urging of the rocker arm 12 about the pivot point 11 to thus activate the band brake 9.

A spring 15 is provided between a right underside portion of the rocker arm 12 and a spring washer 15a. The spring washer 15a has a ball protrusion 16 thereon received in a corresponding recess 17c of an arm 17b of the trigger lever 17a. The arm 17b of the trigger lever 17a rests on a wall portion 6a of the lower housing part 6d. The spring 15 is installed with a smaller initial compression force than the spring 14 and holds through the ball protrusion 16 the trigger lever 17a in the illustrated end position. The trigger lever 17a is rotatably supported in the lower housing part 6d through a bolt 18 and has a bore 19 in the upper section 17d, in which bore is connected a pressure rod 20. A free end 20a of the pressure rod 20 carries a roller 21 which is pressed against a slanted wall 22 in the lower housing part 6d and against the cord 4 into the illustrated position.

A cartridge holder 23 is pivotally connected to the housing 6 by a bolt 24 on the front side 6b of the housing 6. The cartridge holder 23 is, in the illustrated position, secured against pivoting by an elastic blocking hook 25 which is secured to the holder and which engages a nose 26 provided on top of the housing 6.

The cartridge holder 23 contains a filled cartridge 27 and a cartridge piston 29 which can be engaged by the piston 2 on the piston rod 3, so that a liquid or paste can be pushed from the cartridge 27 into a discharge nozzle 28 arranged on a front side of the cartridge holder 23. In place of the cartridge 27, it is also possible to use a bag filled with liquid or paste and having a discharge nozzle, which bag can then be emptied by the piston 2.

FIG. 2 shows a left cross-sectional view of the left end of the inventive dosing gun. A hand wheel 31 is mounted on the left end of the drive shaft 8, with the help of which hand wheel the cord 4 can be wound onto the cord drum 5 and the spring 1 provided in the upper housing part 6a can be compressed.

In place of the hand wheel 31, it is also possible to mount a crank onto the drive shaft 8. The cord 4 can also be wound up when the band brake 9 is not released, because the band brake 9, due to its character, has only a small braking action in this direction of rotation. This braking action can thereby be totally stopped, if during a compressing of the spring 1 the trigger lever 17 is pressed.

Dosing with the inventive dosing gun occurs as follows: The trigger lever 17*a* of the trigger device 17 is operated until the pressure rod 20 has moved so far to the right that the roller 21 can no longer apply any force onto the cord 4. The spring 15 of the rocker arm 12 is thereby further initially compressed, but does not yet have sufficient force in order to reduce the action of the force of the spring 14 onto the band brake 9 such that the band brake 9 is released against the tension of the cord 4 caused by the initial force of the spring 1.

Only upon a further movement of the trigger lever 17*a* is the force of the spring 14 onto the band brake 9 reduced such that the greater initial force of the spring 15 provided between the right underside of the rocker arm 12 and the spring washer 15*a* will cause the braking action to be reduced and allow the spring 1 to move the piston 2 to the right, so that liquid or paste can be moved by the cartridge piston 29 through the discharge nozzle 28. It is possible through a further pressing or squeezing of the trigger lever 17*a* until it hits a stop to proportionally reduce, through the initial compression of the spring 15, the action of the force of the spring 14 onto the band brake 9 such that the band brake 9 is completely released and the spring 1 applies its full force onto the cartridge piston 29.

By allowing the trigger lever 17*a* to retract, the braking force is again proportionally increased until shortly before the illustrated rest position whereat the band brake 9 fully grips the brake drum 7. The roller 21 rests now loosely on the taut cord 4 between the guide roller 30 and the cord drum 5. By allowing the trigger lever 17*a* to retract further until the rest position, the roller 21 is pressed onto the cord 4 and in this manner deflects the cord 4 to a specific path. This measure causes the piston 2 to be pulled back a small amount, so that force no longer acts onto the cartridge piston 29. As a result, liquid or paste is prevented from being urged out of the cartridge.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A dosing gun for liquids and pastes, comprising: a housing having a trigger device with a trigger lever, with which and through repeated operations thereof a piston rod mechanically linked to said trigger level and having a piston thereon is supported for movement in an axial direction so that a cartridge filled with a liquid or paste can be emptied through a discharge nozzle, said housing having a housing part in which is provided said piston rod, a spring in said housing part for continuously urging said piston axially toward said discharge nozzle of the housing, first means which includes a cord drum for providing said spring with an initial amount of compression causes by a movement of said piston against the spring, second means for controlling the release of said initial amount of compression, said second means including a band brake operatively connected to said cord drum and selectively releasable by said trigger level, said first means including, for providing the spring with the initial amount of compression, a cord connected at one end to one end of the piston rod, another end of said cord being wound up onto said cord drum, guide means for guiding a portion of said cord that extends between said cord drum and said piston rod, said second means further including third means operatively connected to the trigger device and movable so as to apply a force to said portion of said cord in response to a release of said trigger device, which force is sufficient to retract said piston against the urging of said spring to prevent an urging of paste or liquid out through said discharge nozzle when no operative force is applied to the trigger device.

2. A dosing gun according to claim 1, including a brake drum arranged integrally with the cord drum, said brake drum being secured with the cord drum on a drive shaft supported in a further housing part of said housing, said brake drum being engaged by said brake band to prevent movement of said cord drum.

3. A dosing gun according to claim 2, wherein said first means includes a hand wheel provided on said drive shaft for winding said cord onto said cord drum, whereby said piston is moved against said spring provided in said housing and said spring is compressible by said piston movement.

4. A dosing gun for liquids and pastes, comprising: a housing having a trigger device with a trigger lever, with which and through repeated operations thereof a piston rod mechanically linked to said trigger lever and having a piston thereon is supported for movement in an axial direction so that a cartridge filled with a liquid or paste can be emptied through a discharge nozzle, said housing having a housing part in which is provided said piston rod, a spring in said housing part for continuously urging said piston axially toward said discharge nozzle of the housing, first means which includes a cord drum for providing said spring with an initial amount of compression caused by a movement of said piston against the spring second means for controlling the release of said initial amount of compression, said second means including a band brake operatively connected to said cord drum and selectively releasable by said trigger lever, a brake drum arranged with the cord drum, said band brake including a brake band surrounding said brake drum, one end of said brake band being secured to a pivot point on said housing and another end to a further pivot point provided on a movable rocker arm mounted on said housing and being movable in response to a movement of said trigger lever.

5. A dosing gun according to claim 4, wherein said rocker arm is rotatably supported about a bolt and has first and second spring means associated therewith, said first spring means being provided between an underside of said rocker arm and a wall portion of said housing, said second spring means being provided between said underside of said rocker arm and a spring washer operatively connected to said trigger device, said first and second spring means being disposed on opposite sides of bolt.

6. A dosing gun according to claim 5, wherein said spring washer has a ball protrusion thereon, said trigger lever includes an arm having therein a recess conformed to said ball protrusion, said ball protrusion being received in said recess such that the arm of the trigger lever rests on said wall portion of said housing.

7. A dosing gun according to claim 4, including a cartridge holder pivotally fastened through a bolt secured on a front side of said housing, said cartridge holder being secured against bending by a blocking hook on said cartridge holder being engaged with a nose provided on said housing.

8. A dosing gun according to claim 7, wherein said cartridge holder contains a filled cartridge and a cartridge piston, said cartridge piston being engageable by said piston of said piston rod to press a liquid or paste from said cartridge into a discharge nozzle arranged on a front side of said cartridge holder.

9. A dosing gun for liquids and pastes, comprising: a housing having a trigger device with a trigger lever, with which and through repeated operations thereof a piston rod mechanically linked to said trigger lever and having a piston thereon is supported for movement in an axial direction so that a cartridge filled with a liquid or paste can be emptied through a discharge nozzle, said housing having a housing part in which is provided said piston rod, a spring in said housing part for continuously urging said piston axially toward said discharge nozzle of the housing, first means which includes a cord drum for providing said spring with an initial amount of compression caused by a movement of said piston against the spring, a cord extending between said cord drum and said piston rod, second means for controlling the release of said initial amount of compression, said second means including a band brake operatively connected to said cord drum and selectively releasable by said trigger lever, said trigger lever being rotatably supported by a bolt on said housing, said trigger lever having a bore in an upper section thereof, said bore receiving one end of a pressure rod therein, a roller secured at a free end of said pressure rod, and said roller engaging a slanted wall on said housing to facilitate an urging of said roller against said cord extending between said piston rod and said cord drum.

* * * * *